US005537480A

United States Patent [19]

Boothroyd et al.

[11] Patent Number: 5,537,480

[45] Date of Patent: Jul. 16, 1996

[54] SOUND OUTPUT SYSTEM

[75] Inventors: Allen Boothroyd, Little Shelford; Anthony P. Ward, Woking, both of United Kingdom

[73] Assignee: Canon Audio Limited, Surrey, United Kingdom

[21] Appl. No.: 378,948

[22] Filed: Jan. 26, 1995

Related U.S. Application Data

[63] Continuation of Ser. No. 101,048, Aug. 3, 1993, abandoned.

[30] Foreign Application Priority Data

Aug. 19, 1992 [GB] United Kingdom ..... 9217646

[51] Int. Cl.[6] ..... H04R 25/00

[52] U.S. Cl. ..... 381/160; 381/159; 381/90; 381/153

[58] Field of Search ..... 381/159, 160, 381/90, 153, 150, 156; 181/175, 198, 199, 145, 156

[56] References Cited

U.S. PATENT DOCUMENTS

| | | | |
|---|---|---|---|
| 4,225,010 | 9/1980 | Smith | 181/155 |
| 4,266,092 | 5/1981 | Barker, III | 179/1 E |
| 4,410,063 | 10/1983 | Yasue et al. | 181/147 |
| 4,421,200 | 12/1983 | Ferralli et al. | 181/144 |
| 4,625,829 | 12/1986 | Sirois | 181/175 |
| 4,629,030 | 12/1986 | Ferralli | 181/155 |
| 4,836,328 | 6/1989 | Ferralli | 181/155 |
| 5,092,424 | 3/1992 | Schreiber et al. | 181/145 |
| 5,131,052 | 7/1992 | Hill et al. | 381/159 |

FOREIGN PATENT DOCUMENTS

| | | |
|---|---|---|
| 0320270 | 6/1989 | European Pat. Off. . |
| 2188811 | 10/1987 | United Kingdom . |
| 2195218 | 3/1988 | United Kingdom . |
| 2240450 | 7/1991 | United Kingdom . |
| WO9207449 | 4/1992 | WIPO . |

*Primary Examiner*—Curtis Kuntz
*Assistant Examiner*—Sinh Tran
*Attorney, Agent, or Firm*—Fitzpatrick, Cella, Harper & Scinto

[57] ABSTRACT

A loudspeaker unit for producing wide dispersion sound for use in wide imaging stereo has a plastic case defined by a front onto which a separate sound mirror fits, and a back. A drive unit fits into a housing located opposite to the sound mirror. A frame of metal or other rigid material provides a mechanical connection between the drive unit and a load-bearing plinth on which the sound mirror is supported. The case front and back together define an upper space behind drive unit that is connected to a lower space beneath the sound mirror by a passage behind a wall of the case front. The three spaces provide a combined volume of gas that provides a reflex load for the drive unit. The overall size of the unit can be reduced without corresponding loss of bass frequency response, and, because the sound mirror is separate from the plinth, a range of drive units of different dispersion patterns can be provided, requiring only alteration in the surface profile of the sound mirror.

11 Claims, 5 Drawing Sheets

SOUND OUTPUT SYSTEM

This application is a continuation of application Ser. No. 08/101,048, filed Aug. 3, 1993, now abandoned.

FIELD OF THE INVENTION

This invention relates to an audio output system and more particularly to a loudspeaker unit which can be used to produce widely dispersed sound and in wide-imaging stereo reproduction of sound, and to a case for a wide dispersion or wide imaging stereo loudspeaker which can accept a range of drive units of different dispersion patterns.

BACKGROUND OF THE INVENTION

The principle of wide-imaging stereo which is used in a number of loudspeakers being manufactured by the present applicants is disclosed in Patent GB-B-2188811. That patent discloses an acoustic reflector provided opposite to a diaphragm of a drive unit which determines the directivity of the speaker output. The reflector is conical and is located with its axis offset from the axis or centre line of the drive unit so as to produce an asymmetric sound distribution, with most of the mid range and high frequency sound being emitted towards an intended listening direction (hereinafter "forwardly"), but in a wide rather than a narrow distribution.

The use of a pair of right and left speakers and a pair of audio mirrors for respectively controlling the directivities of sounds which are output from the pair of speakers, with the shapes or arrangement of the pair of mirrors being adjusted so that a difference between the arrival times of the sounds which are respectively output from the pair of speakers can be compensated by a sound pressure difference due to the Hass effect in a predetermined area is disclosed in our EP-A-0320270. That specification also discloses that the sound mirror should have concave sides when viewed in profile so as to widen the sound distribution vertically as well as in a horizontal plane.

Our patent specification WO 92/07449 discloses a speaker unit having a drive unit fitting within a generally hemispherical housing which is supported cantilever-wise above a generally conical sound mirror. The axis of the drive unit is offset relative to the axis of the sound mirror to enhance the distribution of high frequency and mid range sound forwardly towards a preferred listening direction. The drive unit has concentric first and second diaphragms provided in one embodiment by a parasitic tweeter, and directs a narrow beam of high frequency and mid range sound towards the sound mirror, from which it can be reflected into a room to produce the desired sound distribution. The use of a single drive unit with concentric diaphragms for high frequency and mid range (and optionally also low frequency) sound gives rise to a relatively easily controllable pattern of reflected and diffracted sound. The housing is supported above the sound mirror on a pair of struts which have lengths greater than their widths and are directed towards the axis of the drive unit so as to minimise their effect on the sound reaching the listener. In the practical form of that speaker, the housing and the sound mirror are separate components between which there is no gas flow path, so that the only gas to provide a reflex load for the drive unit is that in the housing behind the drive unit. The need for a given gas volume to provide an adequate load for the drive unit imposes a minimum size on the enclosure within which that drive unit is contained. A further feature of the practical form of the speaker disclosed in this specification is that the case for the speaker, including the sound mirror, is made of metal which adds to the cost. Furthermore, if one drive unit is changed for another having different dispersion characteristics, it may be desirable to redesign the mirror to take account the different characteristics, and this cannot easily be done without retooling, which imposes a practical limit on the range of different drive units that can be used.

One problem with which the invention is concerned is to provide a compact loudspeaker casing for a wide dispersion or wide-imaging stereo loudspeaker which contains a relatively large effective internal volume that provides adequate reflex loading for the drive unit to achieve a desired low-frequency response.

A further problem with which the invention is concerned is the provision of a loudspeaker unit in which the casing, including the audio mirror, can be made largely or completely of plastics without introducing unacceptable resonances resulting from the limited rigidity of the plastics material.

A yet further problem with which the invention is concerned is the provision of a case for a loudspeaker to be used in wide-imaging stereophonic reproduction of sound, in which there can be fitted a range of drive units of different dispersion patterns without redesign of the case as a whole.

SUMMARY OF THE INVENTION

The first problem is solved, according to one aspect of the invention, by providing a gas space beneath or within the sound mirror which communicates with a space behind the drive unit so that said spaces together provide a load for the drive unit.

The invention therefore provides a loudspeaker case comprising a first portion defining a support for a drive unit and a second portion located away from the first portion, wherein a gas-filled space in the second portion of the case communicates with a further gas-filled space in a portion of the case behind the drive unit so that the gas in said spaces together provides a reflex load for the drive unit. In a preferred structure, the second portion is disposed opposite to the first portion and defines or supports a sound mirror.

The volume of the portion of the internal space associated with the sound mirror is typically about 50% of that of the portion of the internal space associated with the drive unit. In an example, a drive unit requiring to be loaded by six liters of air may have four liters behind the drive unit communicating with two liters behind the sound mirror so that they together provide the required loading volume. In a speaker having two coupled spaces as aforesaid, there can be a noticeable reduction in overall size compared to a similar speaker in which the only loading air for the drive unit is in a closed space behind the drive unit, without a corresponding fall off in low frequency reproduction being apparent. It will be appreciated that a relatively wide and unrestricted passage should be provided between the two portions of the internal space of the casing, otherwise the two portions will not act as a single load and the benefits from the additional coupled gas volume associated with the sound mirror will not be fully realised.

In a preferred construction, connector means such as a wall or walls is provided between the first and second portions of the case for holding them in a predetermined spatial relationship, and the gaseous communication between the spaces is through the connector means. Most of the directional mid-range and high frequency sound from the loudspeaker is forward-going from the front portion of the sound mirror. It therefore may be sufficient to provide a sound mirror which is generally semi-circular when viewed in plan with its curved portion facing forwardly in the intended listening direction. In that case, the connector means may be located behind the sound mirror and there may be a single gas passage providing such a connection, although the use of two or more gas passages is not excluded provided that they have the effect of coupling the gas volumes to provide the required load. Thus the connector means may be defined between a wall extending between the first and second portions and a back member forming part of the casing, the passage being both wide and deep. The wall defining the front of the passage is preferably convex when viewed from the front in order to disperse unwanted reflected sound away from the intended listening direction or zone. The aforesaid loudspeaker case may have the drive unit located with its rim at least approximately coinciding with an axis of the sound mirror to provide the desired forward distribution of sound.

In a second aspect, the invention provides a case for a loudspeaker, said case having a drive unit and a sound mirror for redirecting and dispersing the sound from the drive unit, wherein the case is made wholly or principally of plastics and contains a rigid member of metal or other material providing substantially greater stiffness than the body of the case, said member providing a path along which mechanical loads between the drive unit and a load-bearing region of the case are stiffly reacted.

The invention further provides a case for a loudspeaker having a drive unit and a sound mirror for redirecting and dispersing the sound from the drive unit, wherein the case has a body and a sound mirror which is separate from and fits onto the body.

BRIEF DESCRIPTION OF THE DRAWINGS

An embodiment of the invention will now be described, by way of example only, with reference to the accompanying drawings, in which.

DESCRIPTION OF THE PREFERRED EMBODIMENTS

Figure 1:
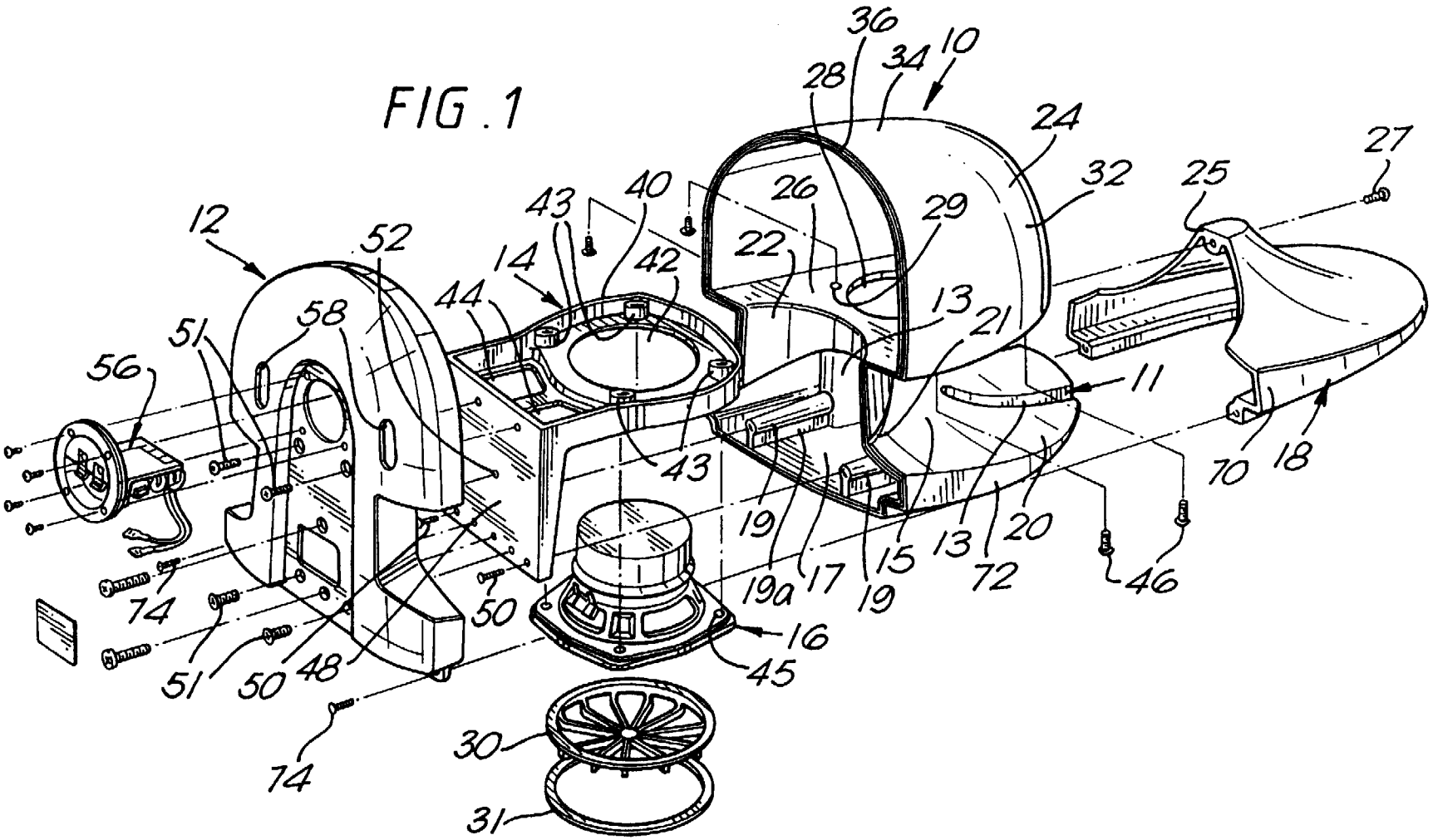
FIG. 1 is an exploded view of a loudspeaker unit according to the invention.
Figure 2:
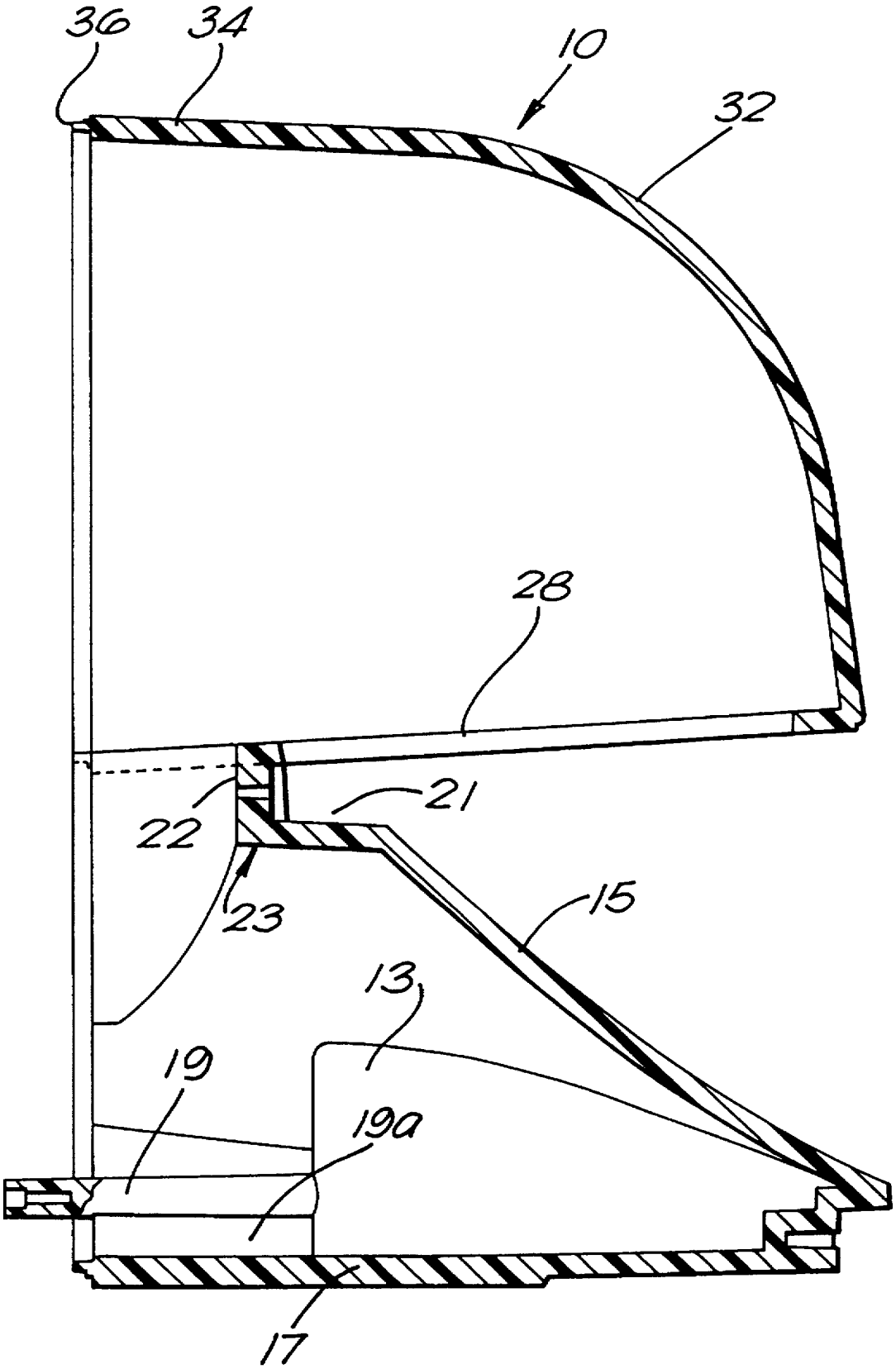
FIGS. 2, 3 and 4 are views of a front case forming part of the loudspeaker of FIG. 1 in vertical section, front and plan view respectively.
Figure 3:
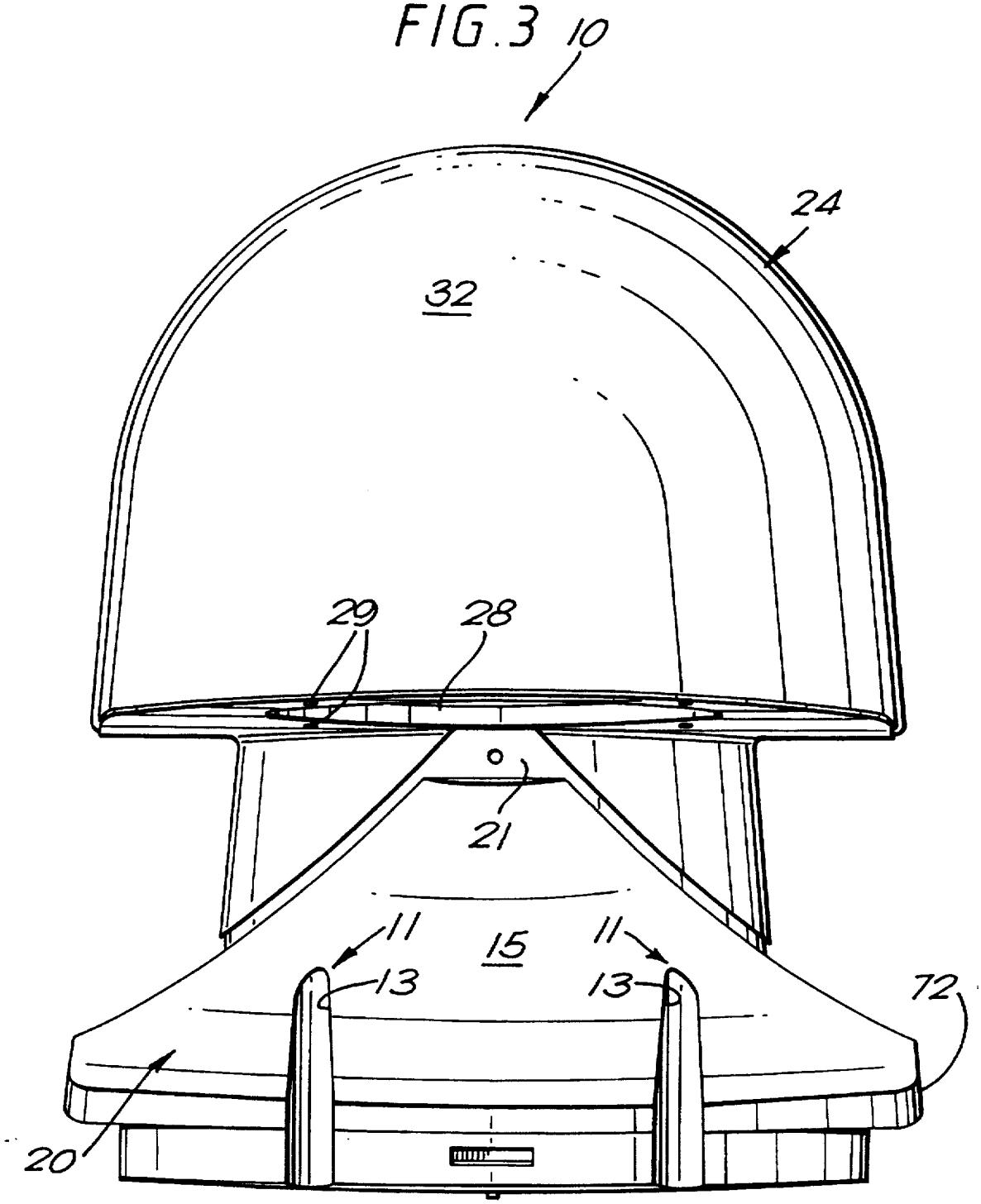
Figure 4:
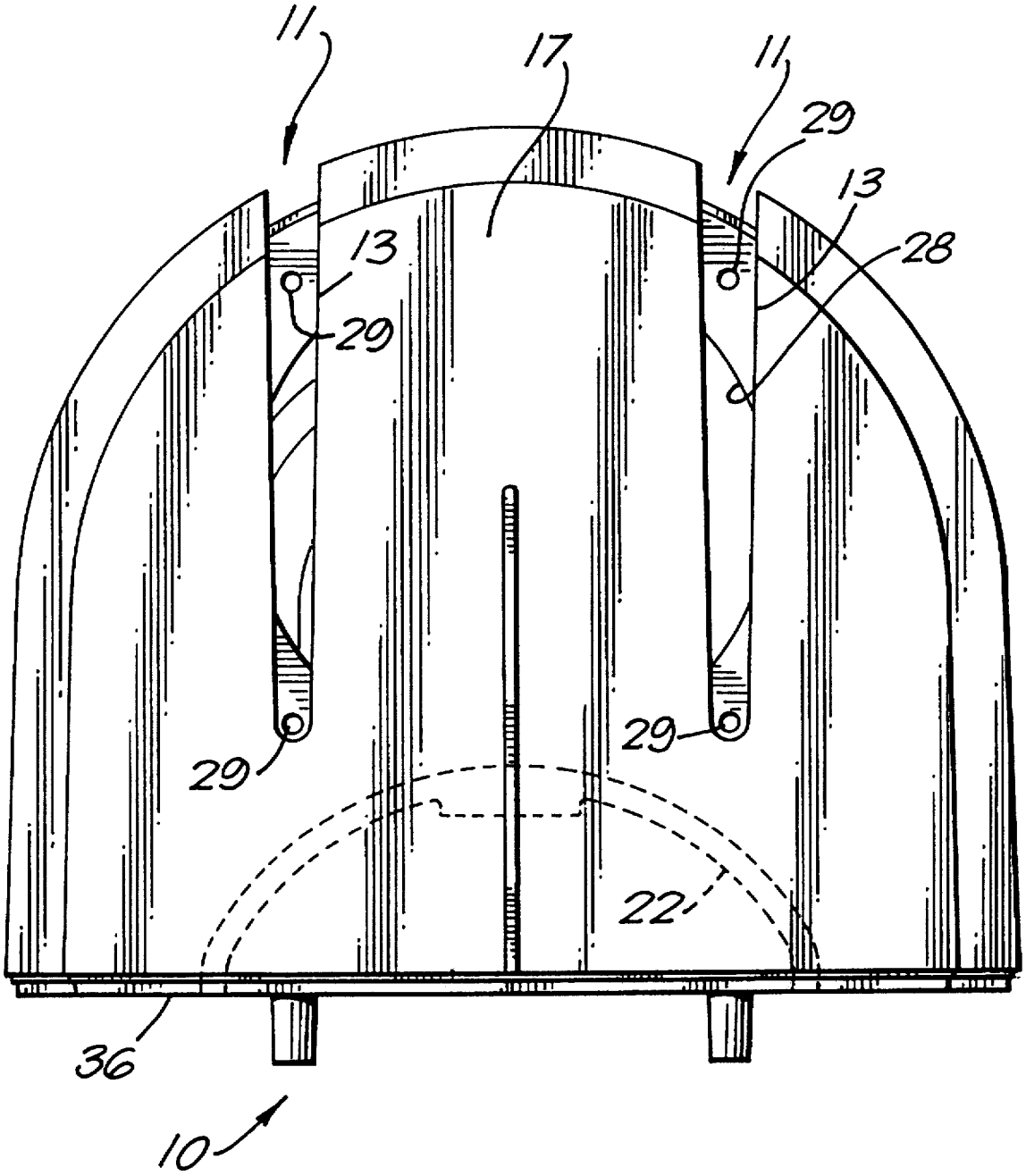

In the drawings, a loudspeaker unit to be used as one of a pair in wide-imaging stereo is of an overall height about 270 mm and has an internal free gas volume of about six liters as aforesaid. It comprises a case front 10, a case rear 12 that fits gas-tightly to the case front 10 to define a case for the loudspeaker, a rigid frame 14 that fits into the case front 10, a drive unit 16 that is carried within the frame 14 and fits into the case front 10, and a half-conical sound mirror 18 that fits demountably onto the case front 10. The case front 10 and case rear 12 are mouldings in 0.3% by volume foaming agent high impact polystyrene and can be painted matte black or any other desired colour. The frame 14 is preferably of metal and is conveniently a casting in zinc, aluminium or an alloy thereof. The use of a frame 14 made of a high stiffness plastics material, e.g. a carbon-filled nylon or other resin is not excluded, although components in such composite materials can be expensive to manufacture. The drive unit 16 may be of any conventional kind and may have a separate concentric tweeter or a parasitic tweeter. The sound mirror 18 is a self-coloured injection moulding in ABS or other suitable plastics and because of its manufacturing process can have a high gloss on its surface at the time when it leaves the mould so that it can be used without the need to apply a decorative finish.

Figure 5:
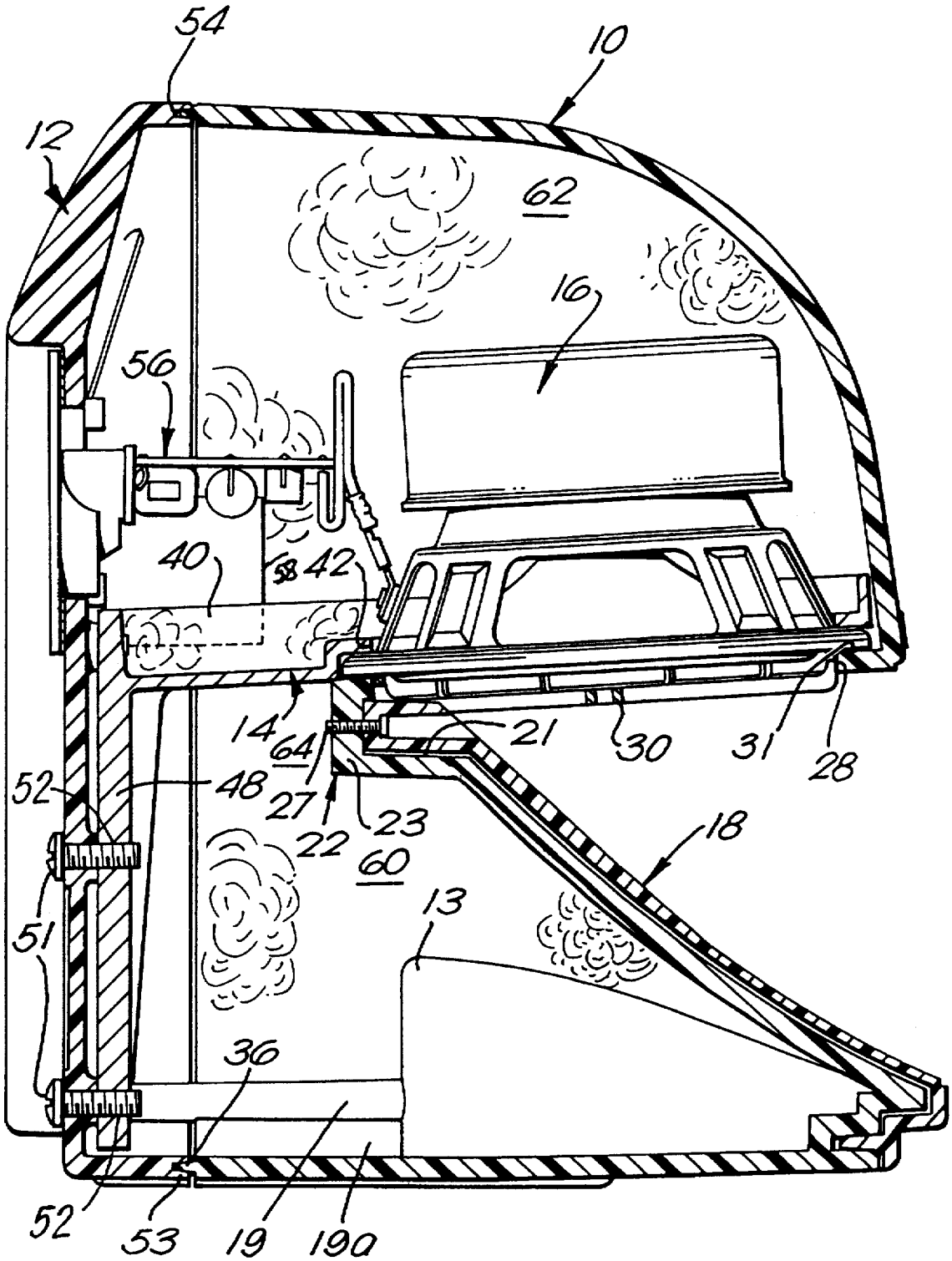
FIG. 5 is a view of the loudspeaker unit in vertical section.

The case front 10 which is a thin-walled hollow shell wholly of plastics comprises a plinth 20 of curvilinear outline corresponding to that of the half-conical sound mirror 18 which is a sliding fit onto it, a back wall 22 arising from a central region of the back edge of the sound mirror, and a drive unit housing 24 which is carried from the top of the wall 22. The plinth 20 is formed with a pair of oppositely laterally offset rearwardly directed slots 11 opening to its front edge, which slots are bounded by vertical walls 13 interconnecting the top 15 and the base 17 of the plinth 20. Fixing bosses 19 extend rearwardly from adjacent the back lower ends of the walls 13 parallel to the base 17 to which they are connected by reinforcing webs 19*a*. The wall 22 is formed with a rebate 21 into which a rear edge 25 of the sound mirror 18 fits and with a mounting point 23 (FIG. 5) for receiving a top fixing screw 27 of the sound mirror. It is convex and is circular when viewed in plan so that high frequency sound reflected from it is so far as possible directed sideways and is not unduly intrusive in the intended listening direction. The housing 24 for the drive unit has a planar horizontally directed base wall 26 formed with an aperture 28 into which the drive unit 16 and a grille 30 for it fit and also formed adjacent the aperture with screw-holes 29 disposed in a pattern corresponding to that in the drive unit 16. A gasket 31 fits between the grille 30 and the base wall 26. The slots 13 in the plinth 20 both give screwdriver access to the screw-holes 29 in the base wall 26 to facilitate fixing of the drive unit 16 in place during assembly and serve to stiffen the plinth 20 in a front-to-back direction.

The housing 24 is further defined by a dome which arises from the base wall 26 and has a quarter-spherical front region 32 merging into a generally cylindrical rear region 34. The outer surface of the dome is visible to the user of the loudspeaker, and has to be uniform without any moulded-in bosses providing attachment points because these could give rise to sink-marks detracting from the appearance of the loudspeaker unit. Therefore such attachment points are not available to provide necessary resistance to movement of the housing 24 relative to the plinth 20 caused by the vibrations of the drive unit 16. As previously noted, the housing 24 is attached to the plinth 20 only by the wall 22 and this does not provide sufficient rigidity to restrain movement of the housing 24 on vibration of the drive unit 16 particularly having regard to the limited stiffness of the plastics material used for the moulding. If this were not corrected audible resonances could occur which would mar the sound of the loudspeaker unit.

The back edge of the case front 10 is provided with a thin rib 36 for sealing to the case back 12.

The necessary rigidity for the case front 10 is provided by the rigid metallic or plastics composite frame 14 which is angular as shown. A top limb 40 receives the drive unit 16 and the grille 30 carried by it in an aperture 42, and is formed with internally threaded bosses 43 for receiving fixing screws 46 passed through the holes 29 in the base wall 26 and through plain fixing holes 43 of the drive unit 16. Relatively large cut-outs 44 are formed in the top limb 40 between the speaker aperture 42 and the back edge. These cut-outs both save material and more importantly provide a relatively large area path for sound-transmitting gas movement from one side to the other of the frame 14. A vertical limb 48 is attached by fixing screws 50 to the bosses 19. The frame 14 therefore provides a rigid mechanical connection between the drive unit 16 and the base 17 of the plinth. By this means the drive unit 16 is rigidly connected to the plinth 20 and reaction to the vibrational loads imposed by the drive unit 16 is principally through the frame 14 rather than through the wall 22 and is stiffly reacted. The plinth 20 rests on a support surface such as a bookshelf on rubber or other feet and acts as a load-receiving surface.

The housing back 12 is of shallow convex curvature when viewed from its outer face and fits onto and is supported by the frame 14 using fixing screws 51 received in threaded holes 52 of the limb 48. An inturned flange of the back 12 is formed at its end face with a groove 53 (FIG. 5) in which the rib 36 is received, a gasket 54 of elastomeric material forming a gas-tight seal between the case front and back as shown. The housing back 12 carries an electrical connector assembly 56 for the drive unit 16 and is provided with a pair of tubular bass reflex ports 58 (see also FIG. 5) in communication with the interior of the housing 24. It may be seen that the whole interior of the loudspeaker casing forms a single chamber constituted by a first region 60 in the plinth below the sound mirror 18, a second region 62 within the housing 24 and a connecting region 64 defined between the wall 22 and portions of the case rear 12 and forming a wide deep passage in which the cut-outs 44 of the frame 14 are present so that the frame 14 does not unduly disturb gas movement. The regions 60, 62, 64 are filled with wadding as is conventional in order to damp out unwanted resonances. The volume of air providing reflex load for the drive unit 16 is therefore not limited to that in the region 62 but includes that in the regions 60,64. It is therefore possible to provide a casing of relatively small size for the drive unit 16 whilst achieving a better bass response than could be provided having regard to the volume of air in the region 62 on its own.

The sound mirror 18 is a separate component from and is a push fit onto the plinth 20. It is a thin moulded plastics shell shaped to define lateral channels 70 in which the sides 72 of the plinth 20 are received so that the sound mirror is a sliding fit onto the base 17, the sound mirror then being retained in position by clamping screws 27,74. It has the shape of a half-cone whose axis coincides with the rim of the larger diaphragm of drive unit 16 as shown, but when viewed in profile has a concave curvature to increase the vertical spread of the reflected sound. It will be appreciated that the surface profile of the sound mirror 18 will be determined in accordance with the dispersion characteristics of the drive unit 16. However, since the sound mirror 18 is separate from the plinth 20, it can be redesigned to have a different surface profile without necessarily involving alteration in the shape of the casing front 10.

It will be appreciated that in the above described embodiment there is provided a compact casing for a wide imaging loudspeaker which nevertheless provides a better than expected bass frequency response, and which can be made largely of plastics, but in which the number of individual components is reduced compared to previous forms of such loudspeaker. Various modifications may, of course, be made to the embodiment described above without departing from the invention, the scope of which is defined in the appended claims. For example, in the embodiment described above, a single drive unit reproduces low frequency, mid range and high frequency sound. In an alternative structure, there could be provided beneath the sound mirror a separate bass speaker, e.g. as described in our International Specification WO 92/07449.

We claim:

1. A speaker unit comprising:

a speaker cabinet having a top portion and a base portion, with said base portion including a plinth;

a drive unit, having a central axis, housed in said top portion for producing and outputting sound; and a sound mirror, having a vertical axis substantially parallel to the central axis and removably mounted on said plinth below said drive unit for deflecting the sound, with said sound mirror forming a shell-like structure which conforms to and fits closely over said plinth wherein said sound mirror includes mounting means for removably mounting said sound mirror on said plinth solely by sliding said sound mirror in a direction substantially transverse to its vertical axis.

2. A speaker unit according to claim 1, further comprising a cantilever support assembly for supporting said drive unit in said top portion.

3. A speaker unit according to claim 1, wherein the vertical axis of said sound mirror is offset from the central axis of said drive unit.

4. A speaker unit according to claim 3, wherein the central axis of said drive unit is disposed forwardly of the vertical axis of said sound mirror with respect to said speaker cabinet.

5. A speaker unit comprising:

a speaker cabinet having an upper portion and a lower portion;

a drive unit, having a central axis, housed in said upper portion for producing and outputting sound;

a sound mirror housed in said lower portion for reflecting the sound output by said drive unit, said mirror having a generally conical surface facing said drive unit for redirecting sound therefrom into a generally horizontal direction, with an apex of said conical surface being closest to said drive unit; and cantilevered support means for supporting said drive unit in a cantilever-type manner above said sound mirror, wherein the central axis of said drive unit is offset from the apex of said sound mirror, with said support means and the central axis of said drive unit positioned on substantially opposite sides of the apex, and wherein said upper portion has a first sub-chamber, said lower portion has a second sub-chamber, and said support means has a third sub-chamber adjoining said upper portion and said lower portion, with said first sub-chamber, said second sub-chamber and said third sub-chamber forming a single chamber having an internal volume for providing a reflex load for said drive unit.

6. A speaker unit according to claim 5, wherein said cantilevered support means comprises a vertical extension and a cantilevered horizontal portion disposed in said upper portion, with said cantilevered support means having cut-outs for providing space in the single chamber formed in said speaker cabinet.

7. A speaker unit according to claim 5, wherein the central axis of said drive unit is disposed forwardly of the apex of said sound mirror with respect to said speaker cabinet.

8. A speaker unit comprising:

a speaker cabinet having an upper portion and a lower portion;

a drive unit, having a central axis, housed in said upper portion for producing and outputting sound;

a sound mirror mounted in said lower portion below said drive unit for deflecting the sound; and cantilevered supporting means for supporting said drive unit in a cantilevered-type manner above said sound mirror, wherein said upper portion has a first sub-chamber, said lower portion has a second sub-chamber, and said supporting means has a third sub-chamber adjoining said upper portion and said lower portion, with said first sub-chamber, said second sub-chamber and said third sub-chamber forming a single chamber having an internal volume for providing a reflex load for said drive unit.

9. A speaker unit according to claim 8, wherein said cantilevered supporting means comprises a vertical extension and a cantilevered horizontal portion disposed in said top portion, with said cantilevered support means having cut-outs for providing space in the single chamber formed in said speaker cabinet.

10. A speaker unit according to claim 8, wherein said sound mirror includes a vertical axis which is offset from the central axis of said drive unit.

11. A speaker unit according to claim 10, wherein the central axis of said drive unit is disposed forwardly of the vertical axis of said sound mirror with respect to said speaker cabinet.

* * * * *

UNITED STATES PATENT AND TRADEMARK OFFICE

CERTIFICATE OF CORRECTION

PATENT NO. : 5,537,480

DATED : July 16, 1996

INVENTOR(S) : Boothroyd et al.

It is certified that error appears in the above-indentified patent and that said Letters Patent is hereby corrected as shown below:

On the title page, item

[30] FOREIGN APPLICATION PRIORITY DATA:

"9217646" SHOULD READ --9217646.0--.

[73] ASSIGNEE:

"Canon Audio Limited, Surrey, United Kingdom" should read --Canon Audio Limited, Woking, United Kingdom--.

Signed and Sealed this

First Day of April, 1997

*Attest:*

*Attesting Officer*

BRUCE LEHMAN

*Commissioner of Patents and Trademarks*